United States Patent [19]

Bartholic

[11] 4,289,605

[45] Sep. 15, 1981

[54] CATALYTIC CRACKING OF METAL CONTAMINATED MINERAL OIL FRACTIONS

[75] Inventor: David B. Bartholic, Watchung, N.J.

[73] Assignee: Engelhard Minerals & Chemicals Corporation, Edison, N.J.

[21] Appl. No.: 122,252

[22] Filed: Feb. 19, 1980

Related U.S. Application Data

[63] Continuation-in-part of Ser. No. 935,890, Aug. 23, 1978, abandoned.

[51] Int. Cl.[3] ..... C10G 11/18

[52] U.S. Cl. ..... 208/113; 208/120; 208/150; 208/164; 208/253; 252/419

[58] Field of Search ..... 208/113, 152, 253, 149

[56] References Cited

U.S. PATENT DOCUMENTS

| | | | |
|---|---|---|---|
| 2,430,015 | 11/1947 | Hatton et al. | 208/52 CT |
| 2,472,723 | 6/1949 | Peet | 208/149 |
| 2,635,749 | 4/1953 | Cropper et al. | 208/52 CT |
| 2,688,401 | 9/1954 | Schmitkons et al. | 208/52 CT |
| 3,092,568 | 6/1963 | Atteridj | 252/251 R |
| 3,944,482 | 3/1976 | Mitchell et al. | 208/120 |

*Primary Examiner*—Delbert E. Gantz
*Assistant Examiner*—G. E. Schmitkons
*Attorney, Agent, or Firm*—Inez L. Moselle

[57] ABSTRACT

Metal contaminated heavy oils such as residual fractions from petroleum distillation are economically converted to gasoline and other light products in catalytic cracking by practice of a novel catalyst makeup policy of adding controlled proportions of both an active cracking catalyst and a substantially inert, large pore solid to replace the amount of catalyst withdrawn from the inventory of a continuous cracking unit wherein catalyst inventory is continuously circulated between a reactor for cracking charge hydrocarbons and a regenerator for burning off the carbonaceous deposit laid down on catalyst in the cracking reaction.

11 Claims, No Drawings

CATALYTIC CRACKING OF METAL CONTAMINATED MINERAL OIL FRACTIONS

CROSS-REFERENCE TO RELATED APPLICATIONS

This application is a continuation-in-part of my copending application Ser. No. 935,890, filed Aug. 23, 1978, now abandoned.

BACKGROUND OF THE INVENTION

The invention is concerned with increasing the portion of heavy petroleum crudes which can be utilized as catalytic cracking feedstock to produce premium petroleum products, particularly motor gasoline of high octane number. The heavy ends of many crudes are high in Conradson Carbon and metals which are undesirable in catalytic cracking feedstocks. The present invention provides an economically attractive method for utilizing the residues of atmospheric and vacuum distillations, commonly called atmospheric and vacuum residue or "resids." The undersirable CC (for Conradson Carbon) and metal bearing compounds present in the crude tend to be concentrated in the resids because most of them are of high boiling point.

When catalytic cracking was first introduced to the petroleum industry in the 1930's, the process constituted a major advance in its advantages over the previous technique for increasing the yield of motor gasoline from petroleum to meet a fast-growing demand for that premium product. The catalytic process produces abundant yields of high octane naphtha from petroleum fractions boiling above the gasoline range, upwards of about 400° F. Catalytic cracking has been greatly improved by intensive research and development efforts and plant capacity has expanded rapidly to a present-day status in which the catalytic cracker is the dominant unit, the "workhorse" of a petroleum refinery.

As installed capacity of catalytic cracking has increased, there has been increasing pressure to charge to those units greater proportions of the crude entering the refinery. Two very effective restraints oppose that pressure, namely Conradson Carbon and metals content of the feed. As these values rise, capacity and efficiency of the catalytic cracker have been adversely affected.

The effect of higher Conradson Carbon is to increase the portion of the charge converted to "coke" deposited on the catalyst. As coke builds up on the catalyst, the active surface of the catalyst is masked and rendered inactive for the desired conversion. It has been conventional to burn off the inactivating coke with air to "regenerate" the active surfaces, after which the catalyst is returned in cyclic fashion to the reaction stage for contact with and conversion of additional charge. The heat generated in the burning regeneration stage is recovered and used, a least in part, to supply heat of vaporization of the charge and endothermic heat of the cracking reaction. The regeneration stage operates under a maximum temperature limitation to avoid heat damage of the catalyst. Since the rate of coke burning is a function of temperature, it follows that any regeneration stage has a limit of coke which can be burned in unit time. As CC of the charge stock is increased, coke burning capacity becomes a bottleneck which forces reduction in the rate of charging feed to the unit. This is in addition to the disadvantage that part of the charge has been diverted to an undesirable reaction product.

Metal bearing fractions contain, inter alia, nickel and vanadium which are potent catalysts for production of coke and hydrogen. These metals, when present in the charge, are deposited on the catalyst as the molecules in which they occur are cracked and tend to build up to levels which become very troublesome. The adverse effects of increased coke are as reviewed above. The lighter ends of the cracked product, butane and lighter, are processed through fractionation equipment to separate components of value greater than fuel to furnaces, primarily propane, butane and the olefins of like carbon number. Hydrogen, being incondensible in the "gas plant," occupies space as a gas in the compression and fractionation train and can easily overload the system when excessive amounts are produced by high metal content catalyst, causing reduction in charge rate to maintain the FCC unit and auxiliaries operative.

These problems have long been recognized in the art and many expedients have been proposed. Thermal conversions of resids produce large quantities of solid fuel (coke) and the pertinent processes are characterized as coking, of which two varieties are presently practiced commercially. In delayed coking, the feed is heated in a furnace and passed to large drums maintained at 780° to 840° F. During the long residence time at this temperature, the charge is converted to coke and distillate products taken off the top of the drum for recovery of "coker gasoline," "coker gas oil" and gas. The other coking process now in use employs a fluidized bed of coke in the form of small granules at about 900° to 1050° F. The resid charge undergoes conversion on the surface of the coke particles during a residence time on the order of two minutes, depositing additional coke on the surfaces of particles in the fluidized bed. Coke particles are transferred to a bed fluidized by air to burn some of the coke at temperatures upwards of 1100° F., thus heating the residual coke which is then returned to the coking vessel for conversion of additional charge.

These coking processes are known to induce extensive cracking of components which would be valuable for catalytic cracking charge, resulting in gasoline of lower octane number (from thermal cracking) than would be obtained by catalytic cracking of the same components. The gas oils produced are olefinic, containing significant amounts of diolefins which are prone to degradation to coke in furnace tubes and on cracking catalysts. It is often desirable to treat the gas oils by expensive hydrogenation techniques before charging to catalytic cracking. Coking does reduce metals and Conradson Carbon but still leaves an inferior gas oil for charge to catalytic cracking.

Catalytic charge stock may also be prepared from resids by "deasphalting" in which an asphalt precipitant such as liquid propane is mixed with the oil. Metals and Conradson Carbon are drastically reduced but at low yield of deasphalted oil.

Solvent extractions and various other techniques have been proposed for preparation of FCC charge stock from resids. Solvent extraction, in common with propane deasphalting, functions by selection on chemical type, rejecting from the charge stock the aromatic compounds which can crack to yield high octane components of cracked naphtha. Low temperature, liquid phase sorption on catalytically inert silica gel is proposed by Shuman and Brace, OIL AND GAS JOURNAL, Apr. 16, 1953, Page 113.

Of the types of catalytic cracking systems, the one of the greatest present interest is Fluid Catalytic Cracking (FCC). The installed plants of this type are characteristically large, and usually designed to process from about 5,000 to 135,000 bbls/day of fresh feed. Briefly, the catalyst section of the plant consists of a cracking section where a heavy chargestock is cracked in contact with fluidized cracking catalyst, and a regenerator section where fluidized catalyst coked in the cracking operation is regenerated by burning with air. All of the plants utilize a relatively large inventory of cracking catalyst which is continuously circulating between the cracking and regenerator sections. The size of this circulating inventory in existing plants is within the range of 50 to 600 tons, the newer plants being designed for short time riser cracking with smaller catalyst inventory than that in older plants. Because the catalytic activity of the circulating inventory of catalyst tends to decrease with age, fresh makeup catalyst usually amounting to about one to two percent of the circulating inventory, which corresponds to about 0.1 to 0.25 lbs. per bbl. of fresh feed, is added per day to maintain optimal catalyst activity, with daily withdrawal plus losses of about like amount of aged circulating inventory, commonly referred to as "equilibrium" catalyst. The considerations which are involved in setting catalyst make-up policy are adequately reviewed in "Dynamic Optimization of Catalyst Make-Up Rate for Catalytic Cracking Systems" W. Lee, Ind. Eng. Chem. Process Des. Development, Vol. 9, No. 1, pp. 154–158 (Jan. 1970). That article provides equations of state and an algorithm for optimizing the make-up rate. The same is hereby incorporated by this reference.

In general, the oils fed to this process are principally the petroleum distillates commonly known as gas oils, which boil in the temperature range of about 650° F. to 1000° F., supplemented at times by coker gas oil, vacuum tower overhead, etc. These oils generally have an API gravity in the range of about 15 to 45 and are substantially free of metal contaminants.

The chargestock, which term herein is used to refer to the total fresh feed made up of one or more oils, is cracked in the reactor section in a reaction zone maintained at a temperature of about 800° F. to 1200° F., a pressure of about 1 to 5 atmospheres, and with a usual residence time for the oil of from about one to ten seconds with a modern short contact time riser design. The catalyst residence time is from about one to fifteen seconds. The cracked products are separated from the coked catalyst and passed to a main distillation tower where separation of gases and recovery of gasoline, fuel oil, and recycle stock is effected.

Petroleum refiners usually pay close attention in the fluid catalytic cracking process (hereinafter referred to as the FCC process) to supplying feedstocks substantially free of metal contaminants. The reason for this is that the metals present in the chargestock are deposited along with the coke on the cracking catalyst. Unlike the coke, however, they are not removed by regeneration and thus they accumulate on the circulating inventory. The metals so deposited act as a catalyst poison and, depending on the concentration of metals on the catalyst, more or less adversely affect the efficiency of the process by decreasing the catalyst activity and increasing the production of coke, hydrogen and dry gas at the expense of gasoline and/or fuel oil. Excessive accumulation of metals can cause serious problems in the usual FCC operation. For example, the amount of gas produced may exceed the capacity of the downstream gas plant, or excessive coke loads may result in regenerator temperatures above the metallurgical limits. In such cases the refiner must resort to reducing the feed rate with attendant economic penalty. Thus, a catalyst inventory that contains excessive deposits of metal is normally regarded as highly undesirable.

The principal metal contaminants in crude petroleum oils are nickel and vanadium, although iron and small amounts of copper also may be present. Additionally, trace amounts of zinc and sodium are sometimes found. It is known that almost all of the nickel and vanadium in crude oils is associated with very large nonvolatile hydrocarbon molecules, such as metal porphyrins and asphaltenes. Crude oils, of course, vary in metal content, but usually this content is substantial. An Arab light whole crude. for example, may assay 3.2 ppm (i.e. parts by weight of metal per million parts of crude) of nickel and 13 ppm of vanadium. A typical Kuwait whole crude, generally considered of average metals content, may assay 6.3 ppm of nickel and 22.5 ppm of vanadium. Regardless of the crude source, however, it is known that distillates produced from the crude are almost free of the metal contaminants which concentrate in the residual oil fractions.

Petroleum engineers concerned with the FCC process have several ways for referring to the metal content of a chargestock. One of these is by reference to a "metals factor", designated $F_m$. The factor may be expressed in equation form as follows:

$$F_m = \text{ppm Fe} + \text{ppm V} + 10\ (\text{ppm Ni} + \text{ppm Cu})$$

A chargestock having a metals factor greater than 2.5 is considered indicative of one which will poison cracking catalyst to a significant degree. This factor takes into account that the adverse effect of nickel is substantially more than that of vanadium and iron present in equal concentrations with the nickel.

Another way of expressing the metals content of a chargestock is as "ppm Nickel Equivalent" which is defined as $$\text{ppm Nickel Equivalent} = \text{ppm nickel} + 0.25\ \text{ppm vanadium}$$

For the purpose of this specification, the value of ppm Nickel Equivalent will be used in discussing metals content of metal-contaminated oils, distillate stocks, and catalysts. As shown above, no mention is made of copper because this metal usually is not present to any significant extent. However, it is to be understood herein that if it is present in significant concentration, it is to be included in the computation of Nickel Equivalent and weighted as nickel.

It is current practice in FCC technology to control the metals content of the chargestock so that it does not exceed about 0.25 ppm Nickel Equivalent. Catalyst make-up is managed to control the activity of the circulating inventory. With this practice, for example, in a plant utilizing 50,000 bbl/day of fresh feed, and an equilibrium catalyst withdrawal of 9 tons per day, the withdrawn catalyst under steady state conditions will contain about 300 ppm Nickel Equivalent of metals, taking into account that the fresh catalyst contributes 70 ppm to this value. Thus, the circulating inventory is maintained at about 300 ppm Nickel Equivalents of metal, which is considered tolerable, the usual range being at about 200 to 600 ppm, with preferred operation being at about 200 to 400 ppm. It is to be understood, of course, that the metals content of the chargestock may vary from day to day without serious disruption, provided that the weighted average of the metals content does not exceed about 0.25 ppm nickel equivalent of metal.

It is important, for the purpose of the present invention, to understand that all references to the metals content of an oil, or of a chargestock, refer to the time-weighted average taken over a substantial period of time such as one month, for example. Because of the large inventory of catalyst relative to the total metals introduced into the system by the chargestock in one day, for example, the metals content of the catalyst changes little each day with fluctuations in the quality of the chargestock. However, a persistent increase in the metals content of the latter will in time result in a well-defined, calculatable increase in the metals content of the circulating inventory of catalyst, which determines the performance of the FCC unit. In fact, it is evident that the calculating inventory of catalyst, by its metals content, provides a time-average value of the metals content of the chargestock. It is in this context, then, that the phrase "metals content of the chargestock" is used herein.

For the purpose of this invention, chargestocks to the FCC process that contain up to about 0.40 ppm Nickel Equivalent of metal contaminants will be regarded as substantially free of metal contaminants. Chargestocks that contain at least about 0.50 ppm Nickel Equivalents of metal will include those chargestocks referred to as metal-contaminated.

The effects of nickel, vanadium and other heavy metals on activity and selectivity of FCC catalysts are discussed in detail by Cimbalo, Foster and Wachtel in a paper presented at the 37th midyear meeting of the API Division of Refining under the title "Deposited Metals Poison FCC Catalyst" and published at pages 112–122 of the Oil and Gas Journal for May 15, 1972, the full contents of which are incorporated herein by reference. Those authors show that metal contaminants of cracking catalyst decline in poisoning activity through repeated cycles of oxidation and reduction and propose a value of "effective metals" determined by multiplication of actual metal concentration by a fraction related to the rate of fresh catalyst make-up as percent of catalyst inventory. Although the authors note that different cracking catalysts may respond differently to metal poisoning and that differences in operation of the regenerator may affect rate of metal deactivation, they establish a single standard for determination of "effective metal" values to be applied generally, presumably having regard to specific catalyst and operating conditions.

The residual fraction of single stage atmospheric distillation or two stage atmospheric/vacuum distillation also contains the bulk of the crude components which deposit as resinous or tar-like bodies on cracking catalysts without substantial conversion. These are frequently referred to as "Conradson Carbon" from the analytical technique of determining their concentration in petroleum fractions. The Cimbalo article above cited classifies coke on spent catalyst in four groups: catalytic coke resulting from cracking of charge components; cat-to-oil, related to reactor stripper efficiency; carbon residue (Conradson) as just discussed; and contaminant coke derived from dehydrogenation reactions promoted by the heavy metal poisons nickel, vanadium, etc. The residual stocks not only provide metal poisoning of the catalyst but also show high Conradson Carbon values which are reflected by coke of that class very nearly equal to the Conradson Carbon number. It will be seen that the increment of Conradson Coke results from deposition on the catalyst of non-volatile hydrocarbons in the charge without significant change in nature of the deposited hydrocarbons.

With very limited exceptions, residual oils have not been successfully included in the chargestocks to the FCC process. The reasons for this are not fully understood, although from the foregoing discussion it is apparent that their high metals content is certainly a major contributing factor, as is the typically high Conradson Carbon. There has been interest in using them, however. The reason for this interest becomes apparent when we consider, for example, that typically only about 26 volume % of an Arab light whole crude is the 650°–1000° F. gas oil fraction, while the total 650° F. plus resid constitutes about 43 volume %. Thus, were it feasible to efficiently operate with residual oil fractions, a very substantial increase in the amount of gasoline plus fuel oil derivable from a barrel of crude could be obtained. In some refineries, the vacuum resid remaining after the distillation of the gas oil is coked and the coker gas oil is included in the FCC chargestock. However, it is generally recognized that coker gas oil, because of its high unsaturated and high aromatics content, is a poor quality feed.

It has been proposed in the prior art to hydrotreat residual oils under such conditions that the metals content is brought into the range commonly associated with gas oils. Such hydrotreated residual oils, substantially free of metal contaminants, may then be used as chargestock or a component thereof for the FCC process. Processes to achieve such metals and sulfur reduction are disclosed in U.S. Pat. No. 3,891,541, issued June 24, 1975 and U.S. Pat. No. 3,876,523, issued Apr. 8, 1975, for example, the entire contents of which are incorporated herein by reference. The combination of hydrotreating to reduce metals and sulfur content followed by cracking also is disclosed in a publication by Hildebrand et al. in The Oil and Gas Journal, pp 112–124, Dec. 10, 1973, the entire contents of this article being incorporated herein by reference. However, no installation is known which has adopted the proposed scheme, probably because the cost and severity associated with the operation involves a heavy economic penalty.

The concurrent problems of heavy metal and Conradson Carbon content of heavy stocks have been approached by the expedient of catalyst modification. U.S. Pat. No. 3,944,482 proposes a cracking catalyst of active aluminosilicate zeolite dispersed in a matrix of large pore refractory inorganic oxide. The patentee suggests that the tendency of the metals to deposit in large pore structures renders the matrix a sacrificial component which protects the active zeolite cracking surfaces of the zeolite from metal contamination. The effectiveness of large pore structures in adsorbing and/or converting metal bearing components of crude is widely recognized. Many hydrotreating catalysts are preferably prepared by deposit of a Group VI metal with nickel or cobalt on a large pore alumina or the like. See also U.S. Pat. No. 3,947,347 on demetallizing petroleum fractions in admixture with hydrogen over a large pore catalyst without added hydrogenation metal catalysts and U.S. Pat. No. 2,472,723 and 4,006,077.

Whether or not the charge stock contains heavy metals, activity of the catalyst added as make up has a profound effect on operation of an FCC Unit and is an important factor considered by the refiner in order to accomplish his objectives. It is usual to consider cracking catalysts in terms of capability to produce gasoline. This takes no account of the very significant proportion of catalytic cracking capacity in refineries producing only minor gasoline yields. In a market having a small demand for gasoline as compared with the demand for light distillate fuels (No. 2 heating oil, jet fuel, diesel fuel, kerosene) FCC Units are operated to minimize gasoline and maximize the distillates boiling above gasoline. Such units will generally employ a catalyst of relatively low activity. To meet the demand for catalysts of various activity levels, catalyst manufacturers stand prepared to deliver different grades of catalyst over a range of activities. One way to accomplish this without conducting manufacturing operations in accordance with a large number of schemes is to manufacture one or a few different catalysts of differing activity. Intermediate grades are conveniently achieved by blending substantially inert particles of like fluidization properties with an active fluid catalyst to thereby provide a total catalyst of lower activity than the active portions. By all these techniques including blending as in U.S. Pat. No. 2,455,915 and the inert, large pore matrix of U.S. Pat. No. 3,944,482, the refiner has at hand a catalyst of fixed activity which he adds to his unit in order to maintain an equilibrium activity according to the equation:

$$A_F = \frac{A_E(S + K)}{S}$$

where $A_F$ is activity of fresh catalyst $A_E$ is equilibrium activity of the total catalyst inventory in the unit S is the rate of make-up in percentage of total inventory per day K is a constant representing rate of catalyst deactivation This is essentially equation (15) of the Lee article cited above, which see for derivation and more detailed explanation of terms. It will be apparent that activity is a relative term, the absolute value of which is dependent on the test procedure. In this specification, "activity" refers to the value determined by a microactivity test (MAT) conducted by cracking a Mid-Continent Gas Oil of the following properties:

| | |
|---|---|
| Gravity, °API | 27.9 |
| CCR, Wt. % | 0.23 |
| Sulfur, Wt. % | 0.6 |
| Initial Boiling Point, °F. | 482 |
| 50% Point | 749 |
| 90% Point | 979 |

The cracking test is conducted by contacting 1.2 grams of the gas oil with 6.0 grams of catalyst (c/o=5) at 910° F. and a feed time of 96 seconds for WHSV of 7.5. The liquid product is distilled and "conversion" is reported as 100 minus weight percent based on feed of liquid product boiling above 421° F. Activity is then calculated as $$A_{MAT} = \frac{\text{conversion}}{100 - \text{conversion}}$$

Methods are known to the art for preparing cracking catalysts of very low activities such as severely steamed amorphous silica-alumina of activity at 1 or less to very high activities above 20 such as highly active aluminosilicate zeolites. See U.S. Pat. No. 3,493,519. Such catalysts of very high activity have not come to the market because existing equipment for catalytic cracking is not capable of utilizing the activity, hence no refiner will pay the higher price which must be charged in view of the high production cost.

In summary, the refiner who presently wishes to charge residual stocks is compelled to adjust his operations to the options available to him. The catalyst make-up rate to his catalytic cracker is determined by the activity considerations spelled out in the Lee article. To avoid adverse effects of metals deposited on the catalyst, the refiner hydrotreats the resid, sends it to a coker or deasphalter or lives with the problem of metal on cracking catalyst of whatever fresh activity he selects.

SUMMARY OF THE INVENTION

A technique for operation of catalytic cracking equipment is now provided which decouples maintenance of equilibrium activity from management of the metals problem. This is accomplished by a catalyst make-up policy for concurrent addition to the unit of two inventory components, namely an active cracking catalyst and a large pore inert solid for selective acceptance of the large molecules characteristic of metal and Conradson Carbon content of the charge. Instead of following the conventional techniques of calculating the amount of fresh catalyst required for maintenance of equilibrium activity or as modified by Lee to consider deactivation rate of catalyst, the system of this invention is based on determination of a make-up rate which will maintain a desired metals level on total inventory including fresh catalyst, partially deactivated catalyst, completely deactivated catalyst (essentially inert porous solids of small pore size) and catalytically inert material of large pore size characteristic of practice of the invention. When charging residual stocks, the make-up rate so determined will be unconventionally high, say upwards of 10% of inventory per day. The activity of catalyst required to maintain equilibrium activity is then calculated by the equation above. The unit is then supplied with a quantity of active catalyst and a quantity of large pore inert solid such that blend of the two exhibits the desired activity and quantity of the two satisfies the make-up rate for metals level maintenance.

DESCRIPTION OF SPECIFIC EMBODIMENTS

The process of this invention contemplates an embodiment in which an FCC Unit is operated at unconventionally high levels of metal on the circulating inventory of catalyst and inert material, hereinafter called "catalyst inventory" for simplicity despite the fact that it contains a high proportion of material not usually considered to be catalyst. Alternatively, the metals content of the catalyst inventory may be held at levels more usual in the art. Thus the invention makes available to the refiner a broad scope of operation from metals levels in the neighborhood of 2 wt % on catalyst (20,000 ppm) or above down to any lower level desired. It will be recognized that levels of nickel, copper, vanadium and the like approximating 2% are high enough that withdrawn catalyst is an ore rich enough to justify hydrometalurgical processing to recover metal values and restore the mixture of porous inert particles and inactivated catalyst to a state suitable for reuse as the inert component of FCC make-up in accordance with the invention. Suitable hydrometallurgy may be treatment with sulfur dioxide and water leach followed by liquid-liquid ion exchange of the leach solution. It will be noted that the metal enriched catalyst is unusually well suited to hydrometallurgy since the metal values are on surfaces rather than combined with silica and the like in the body of the "ore" as is the case with many natural ores.

Whether the metals level on catalyst is held at a value permitting use of withdrawn catalyst as ore or held to a lower number such that withdrawn catalyst is discarded, operation of the catalytic cracking unit is improved by addition of make-up constituted by active catalyst and a large pore inert solid in proportions calculated in accordance with principles of the invention when cracking metal contaminated heavy stocks such as atmospheric or vacuum residue, shale oils, tar sand liquids, coal liquids such as solvent refined coal and the like.

For practice of the invention, the operator of a catalytic cracker will maintain a stock of two different solid materials having physical characteristics (size, density, porosity, etc.) suited to operation of the type of unit. One stock is constituted by cracking catalyst of any desired type, preferably a catalyst of high activity. The catalyst is the more expensive component to be added as make-up and it now becomes feasible in practice of the present invention for the refiner to justify the higher cost of more active catalyst. Thus cracking catalysts of fresh MAT activity above 10 will be found useful and catalysts of fresh MAT activity as high as 20 or above will show economic advantage despite the high cost of such catalysts. The invention can utilize the older amorphous silica-alumina catalysts, but preference is noted for the more active catalysts constituted by rare earth and/or hydrogen forms of crystalline zeolites such as those having the crystalline structure faujasite in a matrix of silica-alumina or the like. Such catalysts are described in U.S. Pat. Nos. 3,140,249 and 3,140,253. Many techniques and compositions for high activity have been described. Although it is preferred to employ catalysts of high activity, the particular means adopted to achieve that high activity is not of particular significance and reference to knowledge in the art will suffice for the present purposes.

The large pore inert material to be added with active catalyst constitutes the real distinction from knowledge of catalyst components normally taken into account by those responsible for operation of catalytic cracking units. As noted above, dilution of cracking catalyst with inert solids is a convenient means by which a catalyst supplier can make several activity levels available with relatively fewer methods of catalyst manufacture. Such blends are sold on the basis of overall activity, selectivity and physical properties such as hardness, tendency to erode equipment and the like. Dilution, if any, is a matter of little concern to the purchaser except as it results in reduced cost of the catalyst blend.

The large pore material is essentially inert in the sense that it induces minimal cracking of heavy hydrocarbons by the standard microactivity test. Conversion by that test will be less than 20, preferably about 10, representing essentially thermal cracking.

The microspheres of calcined kaolin clay preferably used in the process of the invention are known in the art and are employed as a chemical reactant with a sodium hydroxide in the manufacture of fluid zeolitic cracking catalysts as described in U.S. Pat. No. 3,647,718 to Haden et al. In practice of the instant invention, in contrast, the microspheres of calcined kaolin clay are not used as a chemical reactant. Thus the chemical composition of the microspheres of calcined clay used in practice of this invention corresponds to that of a dehydrated kaolin clay. Typically, the calcined microspheres analyze about 51% to 53% (wt.) $SiO_2$, 41 to 45% $Al_2O_3$, and from 0 to 1% $H_2O$, the balance being minor amounts of indigenous impurities, notably iron, titanium and alkaline earth metals. Generally, iron content (expressed as $Fe_2O_3$) is about ½% by weight and titanium (expressed as $TiO_2$) is approximately 2%.

The microspheres are preferably produced by spray drying an aqueous suspension of kaolin clay. The term "kaolin clay" as used herein embraces clays, the predominating mineral constituent of which is kaolinite, halloysite, nacrite, dickite, anauxite and mixtures thereof. Preferably a fine particle size plastic hydrated clay, i.e., a clay containing a substantial amount of submicron size particles, is used in order to produce microspheres having adequate mechanical strength.

To facilitate spray drying, the powdered hydrated clay is preferably dispersed in water in the presence of a deflocculating agent exemplified by sodium silicate or a sodium condensed phosphate salt such as tetrasodium pyrophosphate. By employing a deflocculating agent, spray drying may be carried out at higher solids levels and harder products are usually obtained. When a deflocculating agent is employed, slurries containing about 55 to 60% solids may be prepared and these high solids slurries are preferred to the 40 to 50% slurries which do not contain a deflocculating agent.

Several procedures can be followed in mixing the ingredients to form the slurry. One procedure, by way of example, is to dry blend the finely divided solids, add the water and then incorporate the deflocculating agent. The components can be mechanically worked together or individually to produce slurries of desired viscosity characteristics.

Spray dryers with countercurrent, cocurrent or mixed countercurrent and cocurrent flow of slurry and hot air can be employed to produce the microspheres. The air may be heated electrically or by other indirect means. Combustion gases obtained by burning hydrocarbon fuel in air can be used.

Using a cocurrent dryer, air inlet temperatures to 1200° F. may be used when the clay feed is charged at a rate sufficient to produce an air outlet temperature within the range of 250° to 600° F. At these temperatures, free moisture is removed from the slurry without removing water of hydration (water of crystallization) from the raw clay ingredient. Dehydration of some or all of the raw clay during spray drying is contemplated. The spray dryer discharge may be fractionated to recover microspheres of desired particle size. Typically particles having a diameter in the range of 20 to 150 microns are preferably recovered for calcination.

While it is preferable in some cases to calcine the microspheres at temperatures in the range of about 1600° to 2100° F. in order to produce particles of maximum hardness, it is possible to dehydrate the microspheres by calcination at lower temperatures; for example, temperatures in the range of 1000° to 1600° F., thereby converting the clay into the material known as "metakaolin." After calcination the microspheres should be cooled and fractionated, if necessary, to recover the portion which is in desired size range.

Pore volume of the microspheres will vary slightly with the calcination temperature and duration of calcination. Pore size distribution analysis of a representative sample obtained with a Desorpta analyzer using nitrogen desorption indicates that most of the pores have diameters in the range of 150 to 600 Angstrom units, primarily 300 to 600 Å. In general, the inert materials used in accordance with the invention will have a majority of pores (determined as pores constituting more than half the total pore volume) of at least 100 Angstrom units diameter.

The surface area of the calcined microspheres is usually within the range of 10 to 15 $m^2/g$. as measured by the well-known B.E.T. method using nitrogen absorption. It is noted that the surface areas of commercial fluid zeolite catalysts is considerably higher, generally exceeding values of 100 $m^2/g$. as measured by the B.E.T. method.

Other solids of low catalytic activity and of like pore diameter and particle size may be employed. In general, solids of low cost are recommended since it is contemplated that the high make-up rate characteristic of the invention is offset by low net cost of the catalyst plus inert material to be added.

The invention is applied to a catalytic cracker for which a predetermined activity and metals level have been established. These may vary within rather wide ranges depending primarily on nature of the charge stock and the product slate dictated by market demand. Thus a cracker in a refinery serving a market which demands relatively large quantity of diesel fuel and distillate fuel oils will operate with a catalyst of relatively low activity as compared with one serving a market of high gasoline demand. Predetermined metals level on catalyst will normally be higher when practicing the present invention than would be the case with cracking catalysts of the prior art. The average metal content of the inventory circulated in the unit is determined by analysis and is the predetermined value which is to be held constant.

From observation of unit behavior and monitoring of charge stock analysis, it is determined at what rate catalyst activity declines and at what rate metals are deposited on the total inventory of catalyst and inert materials. With this information, the refiner derives a rate of metal deposition and thus maintains the metal level constant at about the predetermined value. The rate of replacement will be a value in percent of circulating inventory per day which is readily converted to tons of make-up per day having regard to the weight of inventory in the circulating catalyst. In the preferred type of operation charging a residual stock of at least 10 Nickel Equivalents of metal, the rate of make-up is simply obtained by dividing total metal input with charge by the predetermined metals level on inventory in weight percent.

Having established a make-up rate in terms of tons per day or percent of inventory per day, the activity level of active catalyst plus inerts to be added is determined by Lee's equation in the form:

$$A_F = \frac{A_E(S + K)}{S}$$

where $A_F$=activity of make-up blend $A_E$=equilibrium (predetermined) activity of inventory in the unit S=make rate determined as above K=a constant related to catalyst deactivation determined as explained by Lee In the preferred embodiments of the invention using make-up rates of 10% of inventory per day and higher, the make-up rate S is so high compared with the constant K that the latter becomes relatively unimportant to the calculation. Having determined the activity $A_F$ for the make-up blend of active catalyst and inerts, the proportion of the make-up components is derived from the known activity of active catalyst $A_c$ by dividing the desired blend activity by $A_c$ thus $A_F/A_c$=fraction of active catalyst in blend. The two components may be premixed in the required proportions and added to the unit intermittently or continuously at the rate S in tons per day. Concurrently, there will be an amount of equilibrium catalyst withdrawn from the unit to maintain a constant inventory, i.e. an amount of so withdrawn catalyst equal to the amount of make-up blend less losses of catalyst due to attrition and the like. At high metal contents in the neighborhood of 2%, the withdrawn catalyst becomes a valuable "ore" for hydrowinning of nickel, vanadium, copper, etc.

Alternatively, the components of the make-up blend may be added separately to the unit for mixing as the inventory is circulated. This is particularly effective in FCC operations where any added material is very quickly and very thoroughly mixed with the inventory being circulated.

The invention is best utilized in units which provide short contact time of catalyst and charge stock in order that the two components of the make-up blend may act with maximum effectiveness. The desired result is advantageously achieved at contact times less than 20 seconds, preferably 2 seconds or less.

The fresh catalyst should have high activity, $A_{MAT}$ of at least 1.5, preferably 4 or greater. These high activities of the active catalyst component of the blend make possible high proportions of large pore inert material, upwards of 50%, preferably more than 75%.

The combination of short contact time, high proportion of large pore inert material, and high activity of the active catalyst component of the blend provide further advantages in management of coke make in the reactor and control of temperature in the regenerator of an FCC unit. The active catalyst component acquires coke which is primarily due to catalytic cracking. Coke due to dehydrogenation by contaminant metals is at a low-level for these short contact times. Most of the Conradson Carbon coke (additive coke) is deposited on the large pore inert component. Regenerator temperatures may be reduced in this system of operation.

In general, the make-up rate according to the invention will be in excess of 3% of inventory per day and in excess of 0.3 lb./catalyst blend with inerts per barrel of feed, up to 20% of inventory per day, with recommended levels of about 10% of inventory per day for most operations in cracking of metal contaminated resids.

In accordance with usual practice in catalytic cracking, vapor pressure of hydrocarbons in the reactor is advantageously reduced by adding steam with the charge to the unit. According to one embodiment of the invention, the steam is provided by vaporization of water present as the internal phase of a water and oil emulsion with charge hydrocarbons. When that emulsion is heated by contact with hot regenerated catalyst at the bottom of the riser reactor, the emulsified water is vaporized with explosive violence to disperse the oil surrounding the water droplets in the emulsion and thus promote rapid effective contact of charge with catalyst for rapid vaporization of charge.

What is claimed is:

1. In a process for catalytic cracking of a metal-containing hydrocarbon charge by contacting the charge at cracking temperature with a particle form solid cracking catalyst whereby components of the charge are converted to lower boiling hydrocarbons with concurrent deposition on the catalyst of metals from the charge and of an inactivating carbonaceous contaminant, regenerating catalytic cracking activity of the contaminated catalyst by burning carbonaceous deposit therefrom while retaining metals deposited on the catalyst, and contacting catalyst so regenerated with additional such charge, whereby the catalyst accumulates metal to detriment of the cracking reaction and declines in regenerated activity over repeated cycles of charge contact and regeneration; the average activity and metals content of the catalyst inventory being maintained at substantially constant equilibrium values by replacing a portion of the catalyst inventory with fresh catalyst of activity above and metals content below said equilibrium values;

the improvement whereby said equilibrium values of activity and metals content are decoupled which comprises replacing a portion of said catalyst as aforesaid by adding part of such replacement as catalyst of activity above and metals content below said equilibrium values and the remainder as inert porous solid particles of metals content below said equilibrium value and physical characteristics like that of said catalyst and varying the ratio between fresh catalyst and inert particles for separate control of said equilibrium value.

2. A process according to claim 1 wherein said inert solid is characterized by at least 50% of pore volume constituted by pores of at least 100 Angstrom Units diameter.

3. A process according to claim 1 wherein said inert solid is characterized by at least 50% of pore volume constituted by pores of 150 to 600 Angstrom Units.

4. A process according to claim 1 wherein said inert solid is characterized by at least 50% of pore volume constituted by pores of 300 to 600 Angstrom Units.

5. A process according to claim 1 wherein said inert solid comprises a major portion of said total quantity.

6. A process according to claim 1 wherein said fresh catalyst has a MAT activity greater than 4.

7. A process according to claim 1 wherein the time of contact of said charge with said cracking catalyst is less than 20 seconds.

8. A process according to claim 1 wherein the time of contact of said charge with said cracking catalyst is less than 2 seconds.

9. A process according to claim 1 wherein the total quantity of said fresh catalyst and said inert solid per unit of time is substantially equivalent to total metal input with said charge per unit of time divided by said equilibrium metal value.

10. A process according to claim 9 wherein said total quantity of said fresh catalyst and said inert solid has a cracking activity $A_F$ determined by the equation:

$$A_F = \frac{A_E(S + K)}{S}$$

where $A_E$ is said activity equilibrium value, S is the said portion of catalyst replaced as aforesaid in percentage of said catalyst inventory per day, and K is constant representing rate of decay of catalytic activity:

the fraction F of said fresh catalyst in said total quantity being in conformity with the equation:

$$F=(A_F/A_C)$$

where $A_F$ has the meaning defined above and $A_C$ is the activity of said fresh catalyst.

11. A process according to claim 1, claim 4, or claim 10 wherein said inert solid is calcined kaolin having a surface area of about 10 to about 15 square meters per gram.

* * * * *